US006024591A

United States Patent [19]

Foster et al.

[11] Patent Number: 6,024,591

[45] Date of Patent: Feb. 15, 2000

[54] SEALS FOR AN ELECTRICAL CONNECTOR

[75] Inventors: Geoffrey Emerson Foster, Greensboro; Wesley Stephenson, Winston-Salem, both of N.C.

[73] Assignee: The Whitaker Corporation, Wilmington, Del.

[21] Appl. No.: 09/033,807

[22] Filed: Mar. 3, 1998

[51] Int. Cl.[7] ..... H01R 13/52

[52] U.S. Cl. ..... 439/272

[58] Field of Search ..... 439/587, 274, 439/275, 271, 272, 273

[56] References Cited

U.S. PATENT DOCUMENTS

| | | | |
|---|---|---|---|
| 4,940,421 | 7/1990 | Kano et al. | 439/273 |
| 4,973,268 | 11/1990 | Smith et al. | 439/595 |
| 4,998,896 | 3/1991 | Lundergan | 411/961 |
| 5,151,045 | 9/1992 | Cravens et al. | 439/271 |
| 5,538,441 | 7/1996 | Paolucci et al. | 439/587 |
| 5,871,373 | 2/1999 | Pacini et al. | 439/587 |

*Primary Examiner*—Neil Abrams
*Assistant Examiner*—Hae Moon Hyeon

[57] ABSTRACT

An electrical connector assembly includes a receptacle connector (10) matable with a pin header (122). The pin header (122) includes a cavity (126) in which a gasket seal (202) is located. The seal (202) includes a rim (214) that is thicker than a central section (204) surrounded by the rim. The rim bulges inwardly when subjected to elevated temperatures so that excessive stresses are not imposed on the mated connectors. The seal (202) is rectangular and the portions (203, 205) of the seal rim (214) on the shorter end sections are wider than most of the rim along the longer sides. Sections (207 and 209) adjacent a central opening (212) are also wider than adjacent portions of the longer side of the seal rim (214). These wide section prevent the rim from rocking when subjected to compression and prevent the seal from ballooning next to the inside of the rim. Leakage when the seal is subjected to elevated temperatures is thus prevented.

20 Claims, 6 Drawing Sheets

SEALS FOR AN ELECTRICAL CONNECTOR

BACKGROUND OF THE INVENTION

1. Field of the Invention

The present invention relates to seals for electrical connectors such as are used in automobiles, trucks and tractors.

2. Description of the Prior Art

Seals for electrical connectors are well known in the art; e.g., U.S. Pat. Nos. 4,973,268 and 4,998,896. It is now proposed to provide a seal for the receptacle half having an orientation feature and a seal for the header half having a combined peripheral and compression sealing.

U.S. Pat. No. 5,151,045 discloses a gasket type seal, shown in FIGS. 3 and 4 of the this specification, that includes a rim portion that provides peripheral and compression sealing. The rim portion of that prior art seal includes first and second inwardly facing surfaces and an outwardly facing mating surface. That prior art gasket type seal is adapted for use in a cavity of one electrical connector with the mating surface adapted to be compressingly received by an edge of a mating electrical connector inserted into the cavity. The second surface than bulges out into a space defined by said body and rim portions. The rim portion of that prior art gasket type seal has a substantially constant width around the rectangular periphery of that seal. In one embodiment of this invention, the width of the mating surface of this seal is approximately 1.10–1.20 mm around the entire periphery of the seal.

Although the gasket seal disclosed in U.S. Pat. No. 5,551,045 has performed well in service, some leakage has be discovered in at least one test condition. When the connector is heated to 135° C., a submergible air leak test has shown evidence of leakage. Although no safety problems can be attributed to leakage discovered by this test, it is conceivable that the reliability of certain components could be compromised over the life of the component, and it is desirable that this leakage be prevented.

SUMMARY OF THE INVENTION

A gasket seal is used with first and second mating electrical connectors. The gasket seal is located in a cavity in the first electrical connector and engages the second electrical connector when the two connectors are mated. The gasket seal includes a rim on the periphery of the gasket seal with a thickness that is greater than the thickness of a central portion of the seal around which the rim extends. The central portion of the seal includes holes through which terminals on the first electrical connector extend. The width of the rim varies around the periphery of the gasket seal to reduce distortion of the seal when placed in compression between the first and second mating electrical connectors.

Although the location of the leakage path that is present in elevated temperature tests of the prior art connector is not apparent, the wider sections of the peripheral rim eliminate leakage at elevated temperatures. This seal configuration also allows the peripheral seal to bulge laterally so that excessive stresses are not placed on the connectors when subjected to elevated temperatures.

DESCRIPTION OF THE PREFERRED EMBODIMENT

Figure 1:
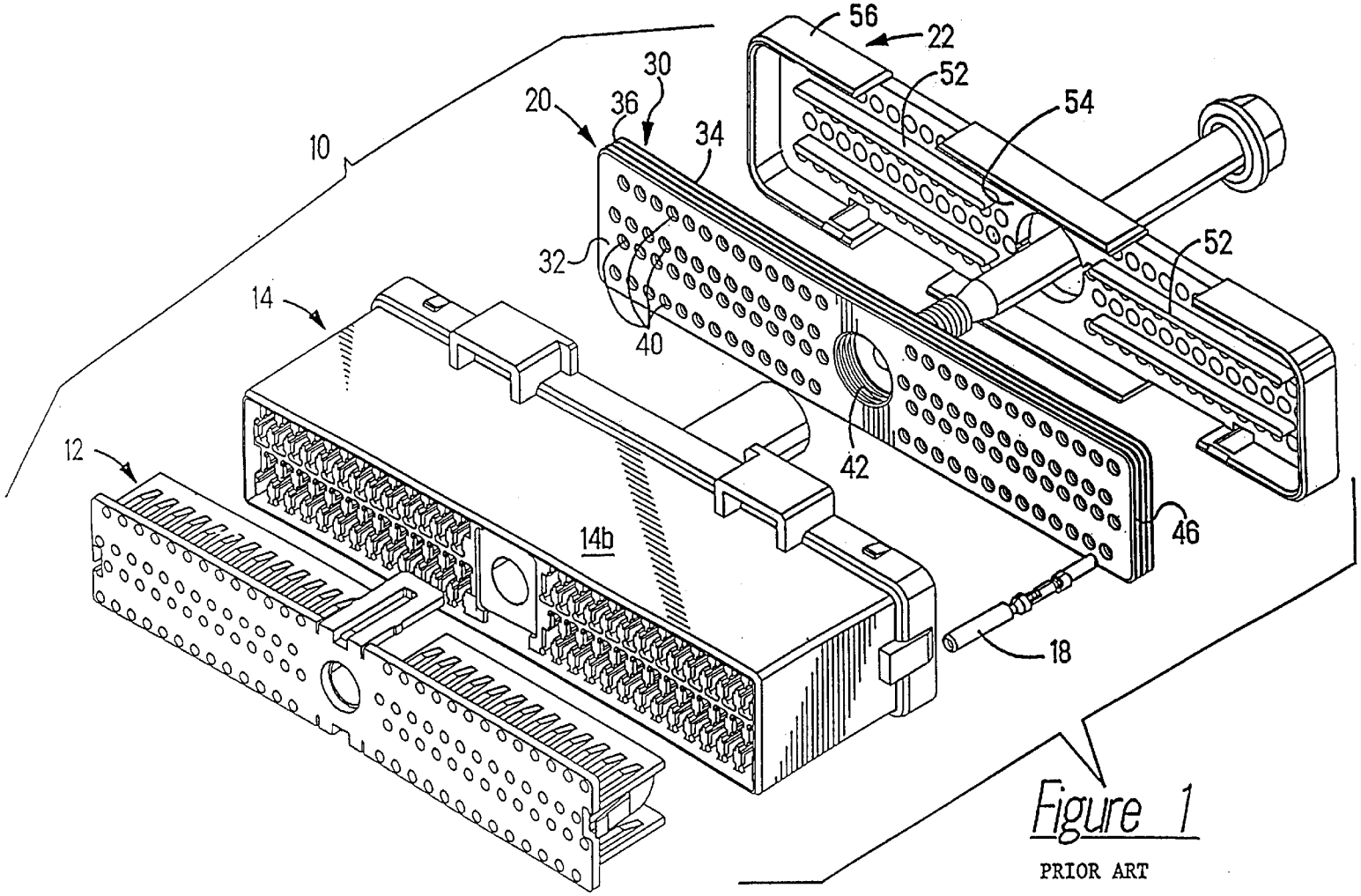
Figure 1 PRIOR ART
FIG. 1 is an exploded view of a receptacle of an electrical connector using a seal of the present invention.

With reference to FIG. 1, receptacle 10 includes terminal position assurance member 12, housing 14, socket terminals 18, rear seal 20 and rear face cap 22.

Figure 2:
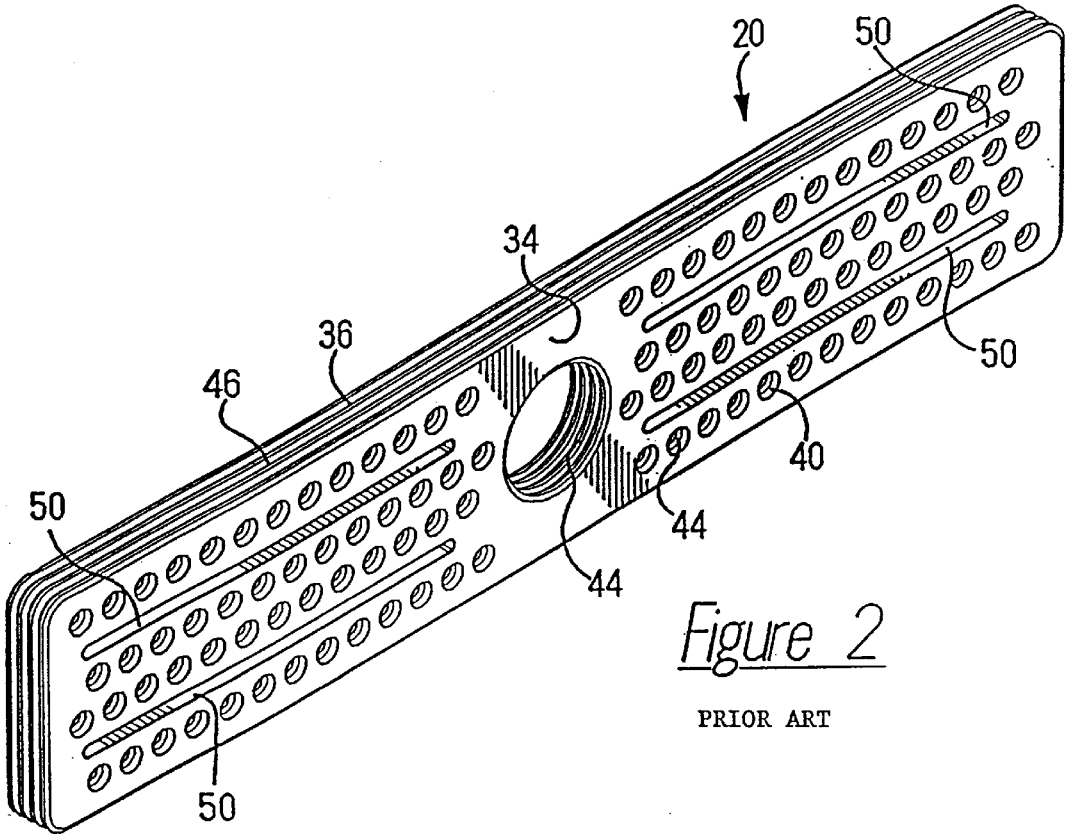
Figure 2 PRIOR ART
FIG. 2 is a view of the seal of the receptacle.

With reference to FIGS. 1 and 2, rear seal 20 includes a body portion 30 with front and rear surfaces 32,34 respectively and edge surface 36 therebetween.

Passages 40, on the same pattern as cavities in housing 14, extend through body portion 30 as does a centrally located large opening 42. The surfaces defining passages 40 and opening 42 are provided with inwardly projecting annular sealing ridges 44.

Outwardly projecting sealing ridges 46 are provided on edge surface 36.

As shown in FIG. 2, a set of four longitudinally extending grooves 50 are provided in rear surface 34 of body portion 30. Grooves 50 are located between rows of passages 40 and on each side of opening 42.

Returning to FIG. 1, ribs 52 are provided on the inside surface 54 of rear face cap 22. These ribs 52 are on the same spacing as are grooves 50 on surface 34 of seal 20.

Grooves 50 and ribs 52 provide an orientation feature which prevents rear seal 20 from being assembled incorrectly. Besides providing a physical indicator, the grooves 50 provide a visual indicator.

Further, ribs 52 are slightly wider than grooves 50 so that upon assembly, the seal material of body portion 30 is compressed between the ribs 52 and side walls 56 of cap 22. Because of this compression, the thickness of body portion 30 is substantially less than what would otherwise be required for adequate sealing.

Figure 3:
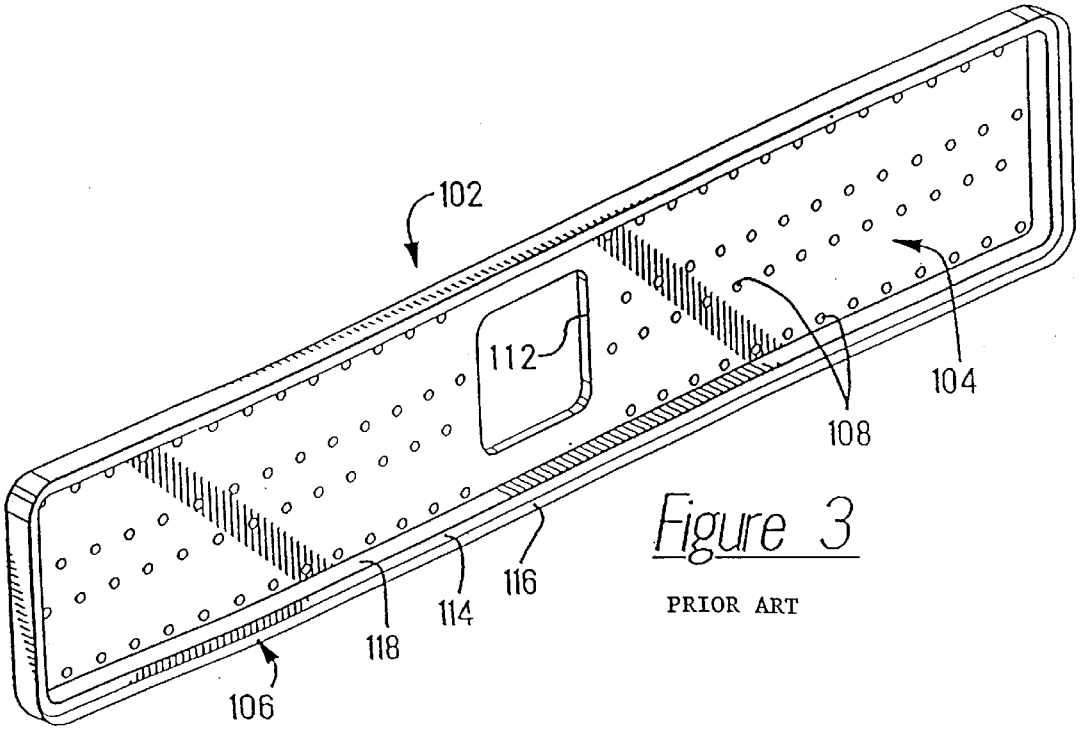
Figure 3 PRIOR ART
FIG. 3 is a view of a prior art gasket seal for pin header.

With reference to FIGS. 2 and 3, prior art seal 102 includes body portion 104 and rim portion 106. Passages 108 in body portion provide access for pin terminals 110 and rectangular hole 112 provides access for a jackscrew 113 as shown is FIG. 1 (see FIG. 5).

Rim portion 106 includes an outwardly facing mating surface 114, a first inwardly facing surface 116 and a second inwardly facing surface 118. Body portion 104 and rim portion 106 define space 120. Seal 102 is preferably molded with a suitable material such as silicon rubber.

The geometry of rim portion 106 provides peripheral and compression sealing in the same space as a compression-only seal would occupy and less space than a traditional peripheral seal. Further, the seal geometry requires less force to compress seal 102.

Figure 5:
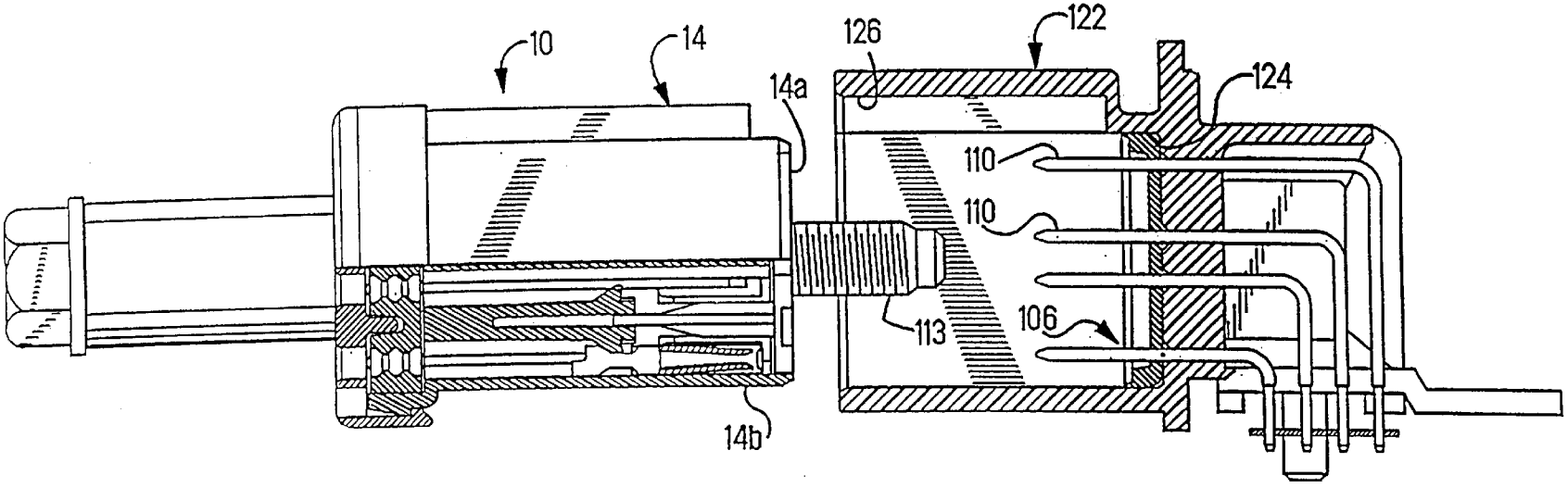
Figure 5 PRIOR ART
FIG. 5 shows the receptacle and sectioned header prior to being joined.
Figure 6:
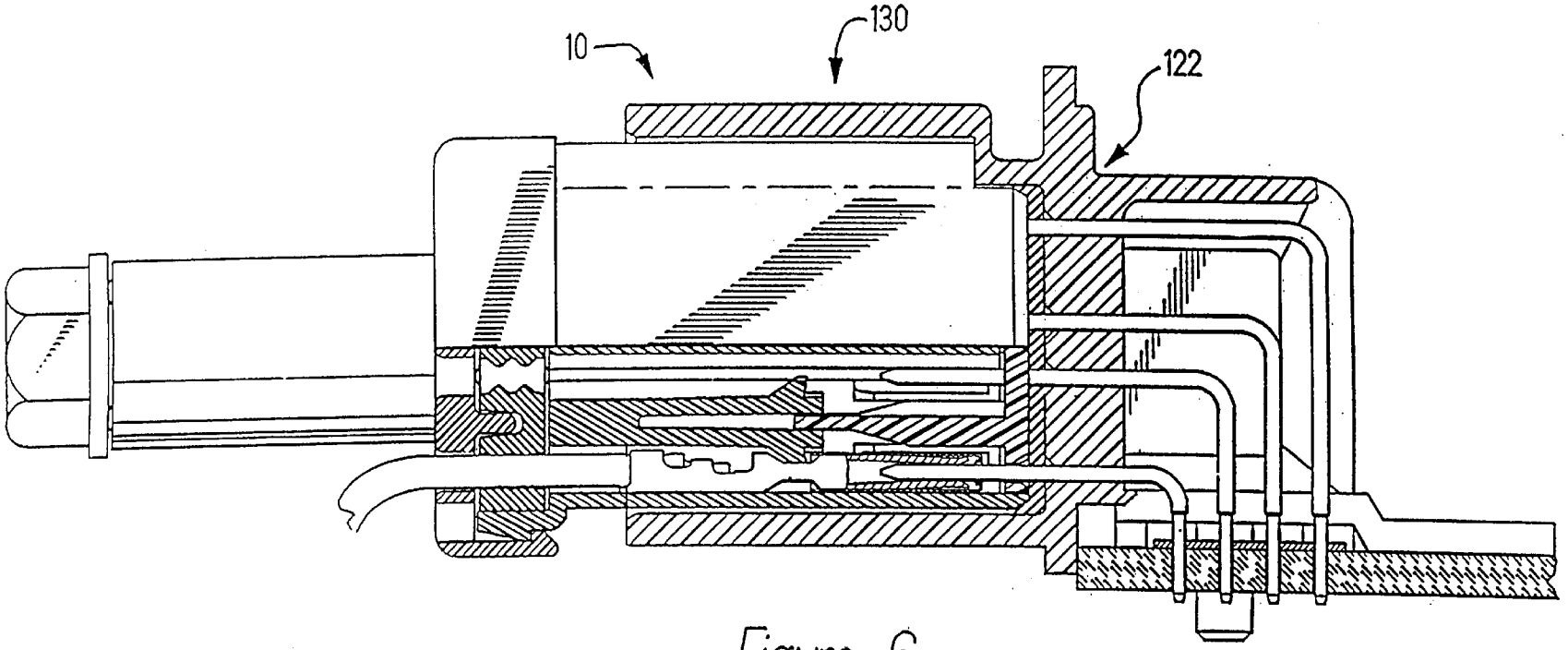
Figure 6 PRIOR ART
FIG. 6 shows the joined receptacle and sectioned header.

FIGS. 5 and 6 illustrate the use of seal 102 in pin header 122 for sealing the juncture with receptacle 10. Seal 102 is positioned on the base or floor 124 of cavity 126 of header 122 with terminals 110 extending through passages 108.

As receptacle 10 and header 122 are joined to provide electrical connector 130, edge 14*b* of housing 14 slides along first inwardly facing surface 116 and edge 14*a* of housing 14 engages mating surface 114. As receptacle 10 and header 122 are tightened up, the seal material beneath surface 114 is displaced such that the second inwardly facing surface 118 bulges out into space 120. Displacing the material requires less force to compress a compression-type seal and solves a problem that was discovered during the testing of connector 30 with a prior art seal, i.e., that in a high temperature environment, the seal material expanded and induced internal stresses in plastic components 10,122 with the result that shrinkage occurred and the components 10,122 drew apart, creating leaks pass the seal. The displacement reduces the compression forces imposed on seal 102 and accordingly less internal stressing is induced into the receptacle 10 and header 122.

Peripheral sealing is obtained between side 14*b* of housing 14 and the first inwardly facing surface 116. This prior art seal thus provides a combination peripheral and compression sealing which reduces internal stresses which can occur in the plastic components and thereby insures continual sealing during elevated temperature exposures.

Although the peripheral prior art seal 102 described thus far does perform a discussed, submergible air leak tests conducted at a temperature of 135° C. have shown that this prior art seal can leak. These tests do not disclose the manner in which these leaks occur, nor do they disclose the location at which the leak occurs. Examination of the mated connector configuration has, however, disclosed a tendency of the rim 114 to rock or pivot when compressed and for the relatively thin center portion 104 of seal 102 to curl or balloon away from the bottom surface of the pin header 122. This ballooning is located adjacent to the rim 106. This inner portion 104 of the seal 102 in one embodiment has a thickness of approximately 1.0 mm. Although FIG. 6 appears to show the bottom of the receptacle connector 10 in engagement along the entire surface of seal 102 including the surface 104, the scale of FIG. 6 is such that the gap along surface 104 cannot be seen in this view. The location of this gap is however apparent from viewing FIG. 5 in which the size of this gap is somewhat exaggerated. These rocking and ballooning areas tend to be pronounced, when magnified, in the vicinity of the ends of the rectangular gasket seal 102 where the seal rim 114 tends to rotate or rock under compression. These ballooning areas extend into the area of the holes 108 through which the pins 110 extend. The mechanism by which this rocking and ballooning could lead to leakage is not understood since the peripheral seal between the mating connectors should not logically be affected by this rocking and ballooning tendency.

Figure 4:
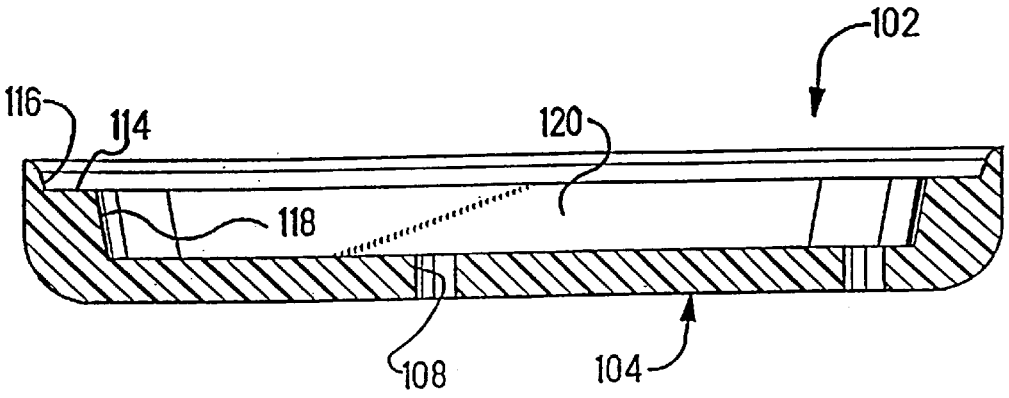
Figure 4 PRIOR ART
FIG. 4 is a sectioned view of the prior art gasket seal shown in FIG. 3.
Figure 7:
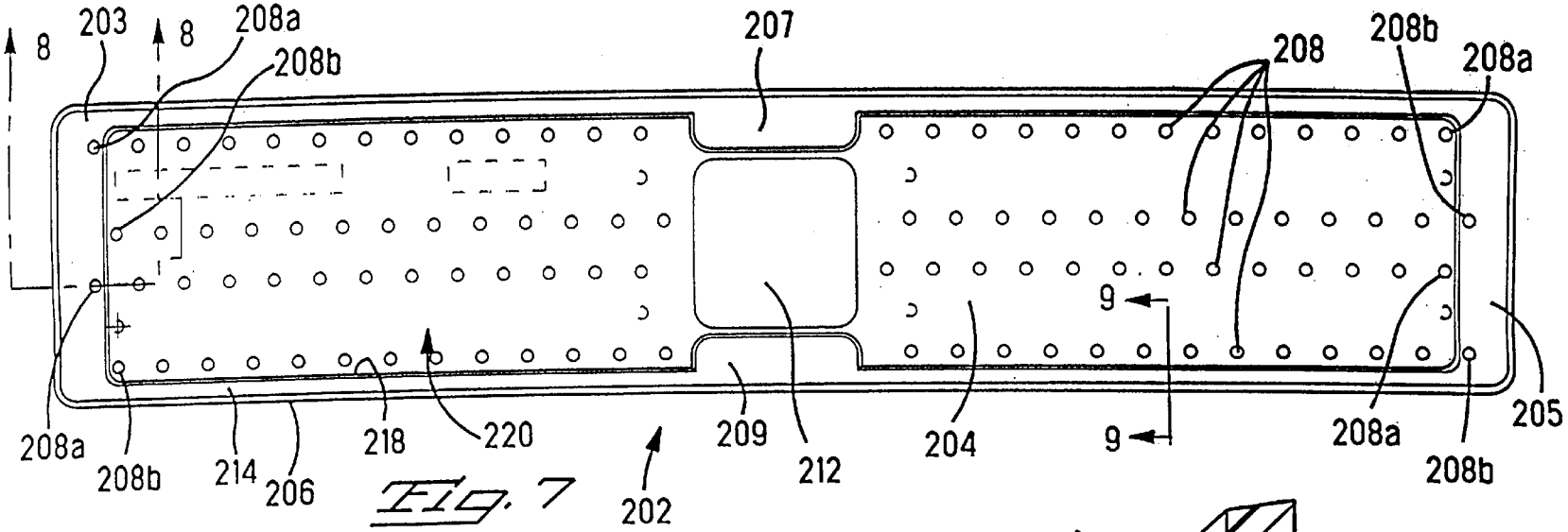
FIG. 7 is a view of the preferred embodiment of the gasket seal having a peripheral rim having a discontinuous width around the periphery of the rectangular gasket type seal.
Figure 9:
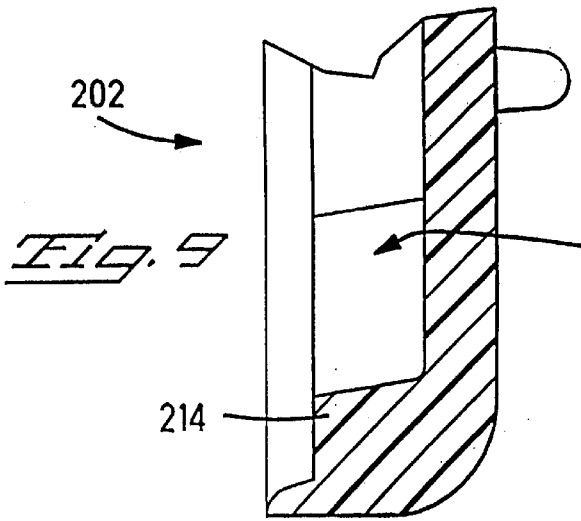
FIG. 9 is a section view taken along section lines 9—9 in FIG. 7 showing the rim on the sides of the seal.
Figure 8:
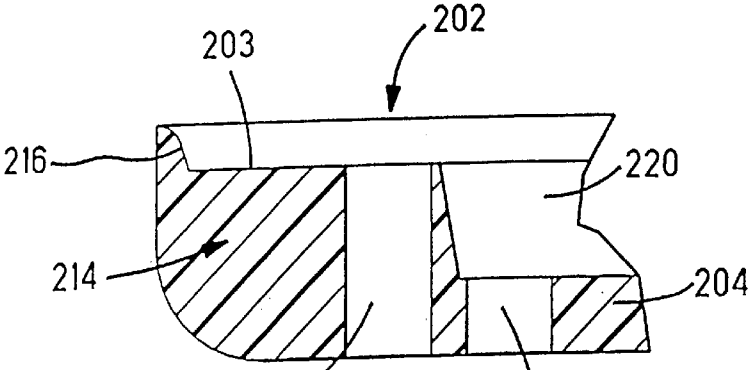
FIG. 8 is a section view taken along section lines 8—8 in FIG. 7 showing the rim on the ends of the seal.

The new gasket seal 202 shown in FIGS. 7–9, which is used with connectors 10 and 122 the manner shown in FIGS. 1,2,5,6 to replace the prior art seal 102 shown in FIGS. 3 and 4 prevents the leakage that can occur when the prior art seal of FIGS. 3 and 4 is tested. New gasket seal 202 also reduces the tendency of the relatively thin central seal section 204 to balloon when compared to the central seal section 104 of seal 102. Although the relationship between the tendency of a seal to rock and to balloon and to leak is not fully understood, the reduced tendency of seal 202 to balloon accompanies the elimination of the leakage exhibited by seal 102 in a submergible air lead test at 135° C.

The seal 202 includes a rim 214 extending completely around the periphery of the seal 202 with the thickness or height of the central seal section 204 being substantially less than the height of the rim 214. Rim 214 includes an inwardly facing surface 218 that bulges inwardly when the seal 202 and the seal rim 214 are compressed when the connectors 10 and 122 are mated. The seal 202 also includes a series of holes 208 through which pins 110 can be inserted. These holes 208 are in four rows and in adjacent rows the holes 208 are staggered so that holes 208*a* in two rows are closer to one end of the seal 202 than the holes 208*b* in the other two rows.

The width of the rim 214 for seal 202 varies at different locations around the periphery of the seal 202 and the width is not substantially constant as for the rim 114 of seal 102. On the ends of the seal 202 the width of the seal rim 214 is larger than along the sides of the rectangular seal. The rim 214 has two ledges 203 and 205 formed along the opposite ends of the rectangular seal. The width of these ledges 203 is greater than the rim along the sides of the seal between ledges 203 and 205. For the preferred embodiment, the width of the rim ledges 203 and 205 is approximately 3.50 mm. The width of the rim along the sides of the seal is approximately 1.1–1.2 mm. As seen in FIG. 7 and 8, the two end holes 208*a* on the left of the seal 202 extend through the rim ledge 203. On the left end in FIG. 8, the holes 208b in the other rows do not extend through the rim ledge 203. In the other staggered rows on the opposite or right end of seal 202, end holes 208*b* extend through rim ledge 205. The width of the ends of rim 214 therefore differs from the width of the rim sides, and therefore the width of rim 214 can be said to be discontinuous.

Seal 202, like seal 102 also includes a rectangular central hole 212 to provide clearance for the fastening screw or bolt that is used to mate the two connectors 10 and 122. The seal 202 is not responsible for providing sealing integrity around this screw or bolt. The seal ribs 44 on the wire seal 20 surround the tower in which the screw or bolt is housed to provide sealing integrity along this surface. An O-ring seal, not shown, is located on the interior of the tower to seal the interior interface between the screw or bolt and the tower. A nut is mounted in the pin header and an interference fit surrounding this nut eliminates any leak path on that end of the screw or bolt.

Seal 202 additionally differs from seal 102 in that the side seal rim 214 contains two enlarged sections 207 and 209 adjacent to the square central opening 212. In the preferred embodiment, the width of these enlarged sections 207 and 209 is approximately 3.50 mm. The length of the enlarged sections 207 and 209 is approximately the same as the length of the central opening 212. These enlarged sections 207 and 209 mean that the width of the sides of rim 214 is not constant between the two ends of the rectangular gasket seal.

Enlargement of selected sections of rim 214 has been found to effectively eliminate the leakage that occurred under test conditions with the prior art seal 102. Although the width of the seal rim 214 has been enlarged at selected locations, the seal rim 214 is still free to bulge laterally along inwardly facing side 218 in the same manner as for the prior art seal 102. Therefore, internal stresses in plastic components under elevated temperatures are avoided for seal 202 in the same manner as seal 102. Sealing integrity under elevated temperatures is also improved by increasing the width of rim 214 in only selected locations, even though the leakage path exhibited under test conditions could not be directly traced to the locations where the width of the rim 214 has been increased.

We claim:

1. A gasket seal for use with first and second mating electrical connectors, the gasket seal being located in a cavity in the first electrical connector and engaging the second electrical connector when the two connectors are mated, the gasket seal including a rim on the periphery of the gasket seal having a thickness that is greater than the thickness of a central portion of the seal around which the rim extends, the central portion of the seal including holes through which terminals on the first electrical connector extend, the gasket seal being characterized in that the width of the rim varies around the periphery of the gasket seal to reduce distortion of the seal when placed in compression between the first and second mating electrical connectors.

2. The gasket seal of claim 1 wherein the width of the peripheral rim is discontinuous with at least one section having a width that is greater than the width of adjacent sections of the rim.

3. The gasket seal of claim 1 wherein the gasket seal is rectangular.

4. The gasket seal of claim 3 wherein the width of relatively shorter end rim sections of the rectangular gasket seal is greater than the width of at least portions of the relatively longer side rim sections.

5. The gasket seal of claim 4 wherein the width of end rim sections is greater than the width of most of the side rim sections.

6. The gasket seal of claim 5 wherein two opposite side rims sections each include an enlarged section.

7. The gasket seal of claim 4 wherein wider end rim sections include at least one hole through which terminals extend.

8. The gasket seal of claim 4 wherein the width of the end rim sections is greater than three times the width of the side rim sections along most of the length of the side rim sections.

9. The gasket seal of claim 3 wherein longer side rim sections include an enlarged section having a greater width than surrounding sections of the side rims.

10. The gasket seal of claim 1 wherein the seal is free to laterally expand under elevated temperatures without inducing excessive stresses in the electrical connectors and without opening leakage paths around the seal.

11. An electrical connector assembly comprising a first and a second electrical connector and a seal located between the first and second electrical connectors to seal a peripheral interface between the first and second electrical connectors in a mated configuration, the seal including a peripheral rim that is loaded in compression when the first and second electrical connectors are in a mated configuration, the rim being free to bulge laterally when subjected to elevated temperatures to reduce stresses imposed on the first and second electrical connectors, the peripheral rim including first sections having a width greater than the width of second sections on the peripheral rim to prevent leakage through the seal.

12. The electrical connector assembly of claim 11 wherein the first sections are enlarged sufficiently to prevent the enlarged sections from rolling when subjected to a compressive force.

13. The electrical connector assembly of claim 12 wherein the first sections are enlarged sufficiently to prevent area of the seal adjacent to the first sections and adjacent to the peripheral rim from ballooning.

14. The electrical connector of claim 13 wherein the width of the first sections is greater than twice the width of the second sections.

15. The electrical connector of claim 11 wherein the seal has a rectangular configuration, first sections being located on the shorter ends of the rectangular seal, second sections being located along the longer sides of the rectangular seal.

16. The electrical connector of claim 15 wherein portions of the longer sides of the rim have a width greater than adjacent portions of the longer sides.

17. The electrical connector of claim 11 wherein the seal includes an opening for receiving a fastening member for holding the first and second connector in a mated configuration, portions of the peripheral rim adjacent to the opening having a width that is greater than the width of adjacent portions of the peripheral rim.

18. The electrical connector of claim 11 wherein the seal includes a plurality of holes through which terminals extend, a first portion of the holes being located in the first sections of the peripheral rim and a second portion of the holes being located in a central portion of the seal surrounded by the peripheral rim.

19. The electrical connector of claim 18 wherein the thickness of the central portion of the seal is less than the thickness of the peripheral rim.

20. The electrical connector of claim 11 wherein the thickness of the peripheral rim is constant.

* * * * *